US006850163B1

(12) United States Patent
Adamczyk et al.

(10) Patent No.: US 6,850,163 B1
(45) Date of Patent: Feb. 1, 2005

(54) SYSTEMS AND METHODS FOR PROVIDING NOTIFICATION OF A LOCATION OF A RESTRAINED PARTY

(75) Inventors: Maria Adamczyk, Alpharetta, GA (US); Hong Thi Nguyen, Atlanta, GA (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 67 days.

(21) Appl. No.: 10/179,815

(22) Filed: Jun. 24, 2002

(51) Int. Cl.[7] ..... G08B 23/00
(52) U.S. Cl. ..... 340/573.4; 340/539.13
(58) Field of Search ..... 340/573.1, 573.4, 340/539.11, 539.13, 539.12

(56) References Cited

U.S. PATENT DOCUMENTS

| | | | | | |
|---|---|---|---|---|---|
| 5,266,944 | A | | 11/1993 | Carroll et al. | 340/825.36 |
| 5,461,390 | A | * | 10/1995 | Hoshen | 342/419 |
| 5,497,149 | A | * | 3/1996 | Fast | 340/988 |
| 5,701,301 | A | | 12/1997 | Weisser, Jr. | 370/428 |
| 5,731,757 | A | * | 3/1998 | Layson, Jr. | 340/573.1 |
| 5,867,103 | A | * | 2/1999 | Taylor, Jr. | 340/573.4 |
| 5,889,474 | A | * | 3/1999 | LaDue | 340/825.49 |
| 5,892,447 | A | * | 4/1999 | Wilkinson | 340/573.4 |
| 6,204,772 | B1 | | 3/2001 | DeMay et al. | 340/686.1 |
| 6,351,221 | B1 | * | 2/2002 | Phillips et al. | 340/825.49 |
| 6,360,101 | B1 | | 3/2002 | Irvin | 455/456.6 |
| 6,374,176 | B1 | | 4/2002 | Schmier et al. | 701/200 |
| 6,424,910 | B1 | | 7/2002 | Ohler et al. | 701/202 |
| 6,639,516 | B1 | * | 10/2003 | Copley | 340/573.4 |

* cited by examiner

*Primary Examiner*—Thomas J Mullen, Jr.
(74) *Attorney, Agent, or Firm*—Woodcock Washburn LLP

(57) ABSTRACT

Systems and methods for notifying a user that a restrained party is within a specified distance of a specified location are disclosed. A method according to the invention includes storing identity data that represents an identity of a restrained party, location data that represents a specified location, and distance data that represents a specified distance from the specified location. A restrained party location signal that represents a current location of the restrained party is received. From the location data and the distance data, a determination is made as to whether the current location of the restrained party is within the specified distance from the specified location. If the current location of the restrained party is within the specified distance from the specified location, an alert is transmitted to one or more contacts.

24 Claims, 7 Drawing Sheets

500

| User Signature | Restrained Party ID | Location | Distance | User Contacts | Comms Pathway |
|---|---|---|---|---|---|
| UserID 1<br>password 1 | 1234<br>"Fred" | Long, Lat | 10 miles | Wilma<br>Police<br>Court | Mobile No.<br>911<br>TeleNo. |
| UserID 2<br>password 2 | 1235<br>"Betty" | * | 1 mile | Barney<br>Barney<br>BammBamm | MobileNo.<br>email_addr<br>PagerNo. |

520 530 540 550 560 570 542 522 510 524 510 572 574 532 534 544

FIG. 5

SYSTEMS AND METHODS FOR PROVIDING NOTIFICATION OF A LOCATION OF A RESTRAINED PARTY

CROSS-REFERENCE TO RELATED APPLICATIONS

The subject matter disclosed herein is related to the subject matter disclosed in U.S. patent application Ser. No. 10/179,441, filed Jun. 24, 2002 and entitled "Systems And Methods For Monitoring And Notification Of Meeting Participant Location." The subject matter disclose herein is related to the subject matter disclosed in U.S. patent application Ser. No. 10/179,340filed Jun. 24, 2002, now U.S. Pat. No. 6,774,840, and entitled "Systems And Methods For Providing Location-Based Arrival Monitoring And Notification." The disclosure of each of the above referenced patent applications is hereby incorporated herein by reference.

FIELD OF THE INVENTION

This invention relates to communication and location systems. More particularly, the invention relates to systems and methods for providing notification that a restrained party is within a specified distance of a specified location.

BACKGROUND OF THE INVENTION

Unfortunately, it is sometimes necessary for a person to obtain a restraining order against another person. A restraining order typically prohibits a restrained party from being within a certain specified distance from a certain specified location related to the restraining party. For example, a restraining order might prohibit the restrained party from being within a certain distance from the restraining party's house or place of business, or from being with a certain distance from the restraining party regardless of where the restraining party is located.

It is possible, however, for the restrained party to violate the restraining order (i.e., to be within the specified distance from the specified location) without the restraining party's knowledge. For example, the restrained party might be waiting outside the restraining party's house while the restraining party sleeps. It is also possible for the restrained party and the restraining party to be in the same place, such as a shopping mall, for example, by pure coincidence, without either knowing that the other is there.

Additionally, even if the restraining party is aware that the restrained party is in violation of the restraining order, the restraining party must take affirmative action to notify authorities, such as the police or the courts. The time that it takes for the restraining party to notify authorities, however, might be enough time for the restrained party to cause harm to the restraining party, or to escape, leaving the restraining party with no proof that the restrained party violated the restraining order.

It would be advantageous, therefore, if there were available systems and methods for providing notification that a restrained party is within a specified distance of a specified location. Such systems and methods would be particularly advantageous if they provided for notification of the restraining party as well as other third parties, such as authorities or emergency services, for example.

BRIEF SUMMARY OF THE INVENTION

The invention provides an alerting service for notifying one or more specified contacts that a restrained party is within a specified distance of a specified location. The location and distance can be specified in the restraining order itself, or provided by a user of the alerting service. The location can be a static location, such as the restraining party's house, for example, or it can be a dynamic location, such as the current location of the restraining party, wherever that might be. The service can also notify authorities automatically if the restrained party is in violation of the restraining order.

According to the invention, the global positioning system ("GPS") can be used in conjunction with wireless phone technology to enable automatic tracking of the restrained party's location. The invention is particularly suitable for the restraining party, though any other user can benefit from it as well. According to the invention, the user can provide the service, via a telephone or web-based interface, for example, with the identity of the restrained party and one or more contacts. The user can also provide one or more locations that, if the restrained party is near to which, will trigger notification of the contacts. The service then monitors the location of the restrained party and, optionally, of the restraining party as well. The service notifies the specified contacts if the restrained party is within the specified distance of the specified location.

A system according to the invention can include a data store that contains identity data that represents an identity of the restrained party, location data that represents a specified location, and distance data that represents a specified distance from the specified location. Receiving means is provided for receiving a restrained party location signal that represents a current location of the restrained party. The system includes determination means for determining from the location signal, the location data, and the distance data, whether the current location of the restrained party is within the specified distance from the specified location. Transmission means is provided for transmitting an alert if the current location of the restrained party is within the specified distance from the specified location. The system can also include a user interface via which a user can provide input data such as the identity data, the location data, the distance data, and the contacts data.

BRIEF DESCRIPTION OF THE SEVERAL VIEWS OF THE DRAWING

Other features of the invention are further apparent from the following detailed description of the embodiments of the present invention taken in conjunction with the accompanying drawing, of which:

FIG. 5 depicts a preferred embodiment of a contacts table according to the invention.

DETAILED DESCRIPTION OF THE INVENTION

Figure 1:
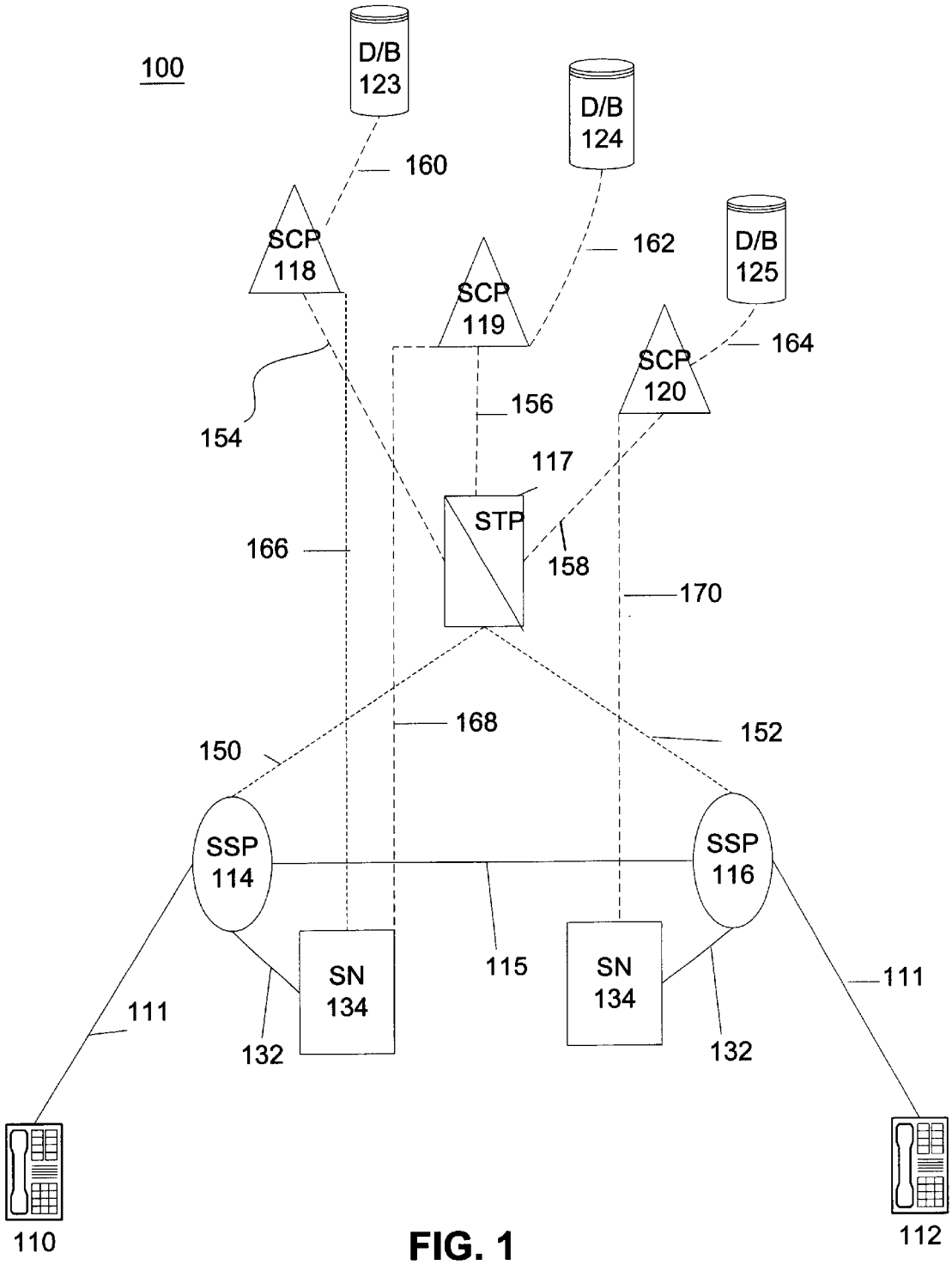
FIG. 1 is a block diagram of an exemplary telecommunication network in which the principles of the invention can be employed.

FIG. 1 is a block diagram of an exemplary telecommunication network 100, such as a public switched telecommunications network (PSTN), in which the principles of the invention can be employed. More particularly, FIG. 1 illustrates a simplified advanced intelligent network (AIN). AIN systems are described in U.S. Pat. No. 5,701,301, the disclosure of which is hereby incorporated herein by reference. Though the various features and aspects of the invention can be utilized in conjunction with an AIN, it should be understood that the invention is not limited to AIN-based systems, and that other networks and system arrangements can be used in accordance with the invention.

As shown, the AIN 100 can include a plurality of service switching points (SSPs) 114, 116. SSPs 114, 116 are capable of generating AIN queries. An SSP, which is also known as a "central office," is basically a switch and the terms are used interchangeably herein. SSPs 114 and 116 can comprise, for example, DMS100 or 5ESS switches. These switches can be manufactured by, for example, Lucent Technologies, Inc. or Nortel Networks.

Each of the SSPs 114, 116 can have one or more subscriber lines 111 connected thereto. Subscriber lines 111 may also be referred to as calling lines. Each SSP 114, 116 serves a designated group of calling lines 111, and thus, the SSP that serves a particular calling line may be referred to as its serving switch. Typically, each calling line 111 is connected to one or more pieces of terminating equipment 110, 112, such as telephones, facsimile machines, computers, modems, or other such telecommunication devices.

SSPs 114, 116 are interconnected by one or more trunk circuits 115. Trunks 115 are basically the voice paths via which communications are connected between SSPs. The term "communication" or "call" is used herein to include all messages that may be exchanged between the calling party and the called party in a telecommunication network, such as illustrated in FIG. 1. Trunk 115 can be either a Signaling System 7 (SS7) controlled multi-frequency (MF) trunk, or primary rate interface (PRI) trunk or the like. The type of trunk will be in accordance with both the sending and receiving SSP to which it is connected.

Each SSP 114, 116 can include different types of facilities and/or triggers. SSPs 114 and 116 are programmable switches that can perform some or all of the following functions: recognize AIN-type calls, launch queries, and receive commands and data to further process and route AIN-type calls. When one of SSPs 114 or 116 is triggered by an AIN-type call, the triggered SSP 114 or 116 formulates and sends an AIN query. Based on the reply from the AIN network, SSP 114 or 116 responds to call processing instructions received.

Each of SSPs 114 and 116 is connected to a signal transfer point (STP) 117 via respective data links 150, 152. Data links 150, 152 can employ SS7, for example, though it should be understood that any suitable signaling protocol could be employed. To facilitate signaling and data messaging, each SSP 114 and 116 can be equipped with Common Channel Signaling (CCS) capabilities, e.g., SS7, which provides two-way communications of data messages over CCS links 150 and 152 between components of the AIN network. The data messages can be formatted in accordance with the Transaction Capabilities Applications Part (TCAP). Alternatively, Integrated Service Digital Network (ISDN) Users Part (ISUP) can be used for signaling purposes between, for example, SSPs 114 and 116. In such a case, SSPs 114 and 116 can be equipped with the capability to map appropriate data between TCAP and ISUP protocols, and vice versa. The telephone network basically employs an upper-level software controlled network through the STPs and the SCP.

SSPs 114 and 116 may allow normal switch processing to be suspended at specific points in a call so that the switch can send an AIN message query via signaling transfer point (STP) 117 to SCP 118, 119 or 120. SCP 118, 119 or 120 may execute software based service logic and return call-processing instructions to the triggering AIN SSP. New services may be provisioned by assigning AIN SSP triggers to customer lines, trunks, and/or NANP (North American Numbering Plan) telephone numbers.

Much of the intelligence of the AIN resides in a type of AIN element referred to as a service control point (SCP) 118, 119, 120 that is connected to STP 117 over an SS7 data link, or the like, 154, 156 or 158. Accordingly, the connections by links 150, 152, 154, 156, and 158 are for signaling purposes and allow SSPs 114 and 116 to send messages to, and receive messages from, SCP 118, 119 and 120.

Among the functions performed by SCP 118, 119, 120 is the hosting of network databases and subscriber databases, which may be stored in respective data storage objects 123, 124, 125. For example, data storage object 123 is shown as a database communicatively coupled via a communication path 160, to SCP 118, although data storage object 123 can be embodied as a component within SCP 118, such as an internally-mounted hard disk device. The databases stored in data storage object 123 may be used in providing telecommunications services to a customer. Typically, SCP 118, 119, 120 is also the repository of service package applications (SPAs) that are used in the application of telecommunication services, enhanced features, or subscriber services to calling lines. Additionally, SPAs may use databases for providing telecommunication services.

A set of triggers can be defined at the SSPs 114, 116. A trigger in the AIN is an event associated with a particular call that initiates a query to be sent to SCP 118, 119, or 120. The trigger causes selected SCP 118, 119, or 120 to access, if necessary, its respective database 123, 124, or 125 for processing instructions with respect to the particular call. The results of the SCP processing and/or database inquiry is/are sent back to selected SSP 114 or 116 in a response through STP 117. The return packet includes instructions to SSP 114, 116 as to how to process the call. The instructions may be to take some special action as a result of a customized calling service, enhanced feature, or subscriber service. In response, switch 114, 116 moves through its call states, collects the called digits, and generates further packets that are used to set up and route calls. Similar devices for routing calls among various local exchange carriers are provided by regional STP and regional SCP.

An example of such a trigger is a termination attempt trigger (TAT), which causes a query to be sent to SCP 118, 119, or 120 whenever an attempt is made to terminate a call on the line of subscriber 110 or 112. Another type of trigger that may be used is a Public Office Dialing Plan (PODP) trigger, though it should be understood that the principles of the invention include the use of other triggers.

The AIN can also include a services circuit node 134 (SCN), which may also be referred to herein as a services node (SN). SN 134 is an interactive data system that acts as a switch to transfer calls. SN 134 may provide interactive help, collect voice information from participants in a call, and/or provide notification functions. SN 134 can be a Lucent Technologies Star Server FT Model 3200 or Model 3300 although other such devices can be employed. SN 134 can include voice and dual tone multi-frequency (DTMF) signal recognition devices and/or voice synthesis devices. In addition, SN 134 can include a data assembly interface. SN 134 can be connected to local SCP 118, 119, 120 via respective data links 166, 168, 170 using an X.25, SS7 or TCP/IP protocol or any other suitable protocol. In addition, SN 134 typically may be connected to one or more (but usually only a few) SSPs via Integrated Service Digital Network (ISDN) lines or any other kind of suitable telephone lines 132.

One skilled in the art will further recognize that the above-described network is a simplified network meant for explanatory purposes. It is likely that a telephone network might include numerous user stations, SSPs, STPs, SCPs, and SNs along with other telephone network elements, and can employ other types of triggers without departing from the spirit and scope of the invention.

Figure 2:
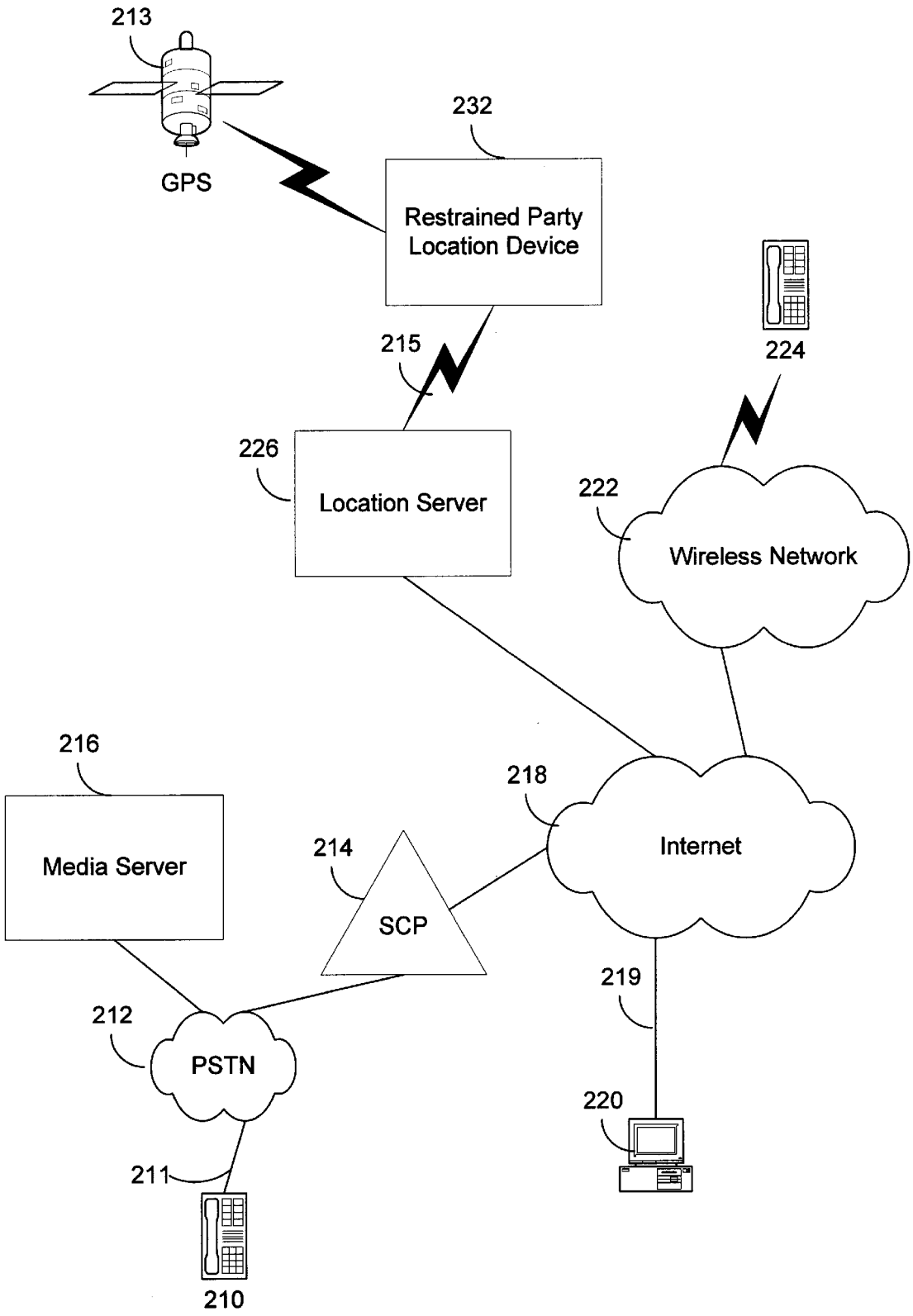
FIG. 2 is a block diagram of a system according to the invention.

FIG. 2 is a block diagram of a preferred embodiment of system according to the invention for providing notification of a restrained party's location. For illustration purposes, as seen in FIG. 2, the present invention can be embodied in a signal control point ("SCP") 214 6f an AIN-based telephone system such as described above. The SCP 214 can include a computer-readable medium having computer-executable instructions thereon for performing a method according to the invention. The present invention can be, however, implemented in other components of an AIN-based telephone network, or in any other telephone network or system. Consequently, the present invention should not be construed to be limited to AIN-based systems.

According to the invention, a user can use a telephone 210 to call into the restraining order alert service, which can be provided as an option in an existing telephone service or as a standalone service. The user's telephone 210 is connected to a PSTN 212 via a calling line 211. The PSTN 212 directs the call to the SCP 214, which performs the main processing (described below) for the alert service.

Alternatively, the user can connect to the alert service via the Internet 218, or any other local or wide area communications network, such as a proprietary intranet for example. The user, via a browser executing on the user's client device 220, can access a web site provided by the alerting service. The client device 220 can be a desktop or laptop computer, a personal digital assistant, or any other such Internet appliance. The SCP 214 can be coupled to the network 218 via a communication link 219. Thus, a user can access the alerting service via a telephone connection or network connection.

A location server 226 can be coupled to the communication network 218 to provide location data to the alerting service. The notification service can poll the location server, for example, to retrieve data that represents the current location of the restrained party.

In a preferred embodiment of the invention, the restrained party can be ordered (by an issuing authority that issued the restraining order) to wear or carry a location device 232 that transmits to the location server 226 location signals 215 that represent the current location of the restrained party. Preferably, the restrained party location device 232 includes a GPS receiver that receives GPS signals from a plurality of GPS satellites, and retransmits the GPS signals to the location server 226. The location server 226 can then compute the current location of the restrained party from the GPS signals. Alternatively, the restrained party location device 232 can be an ankle bracelet or other simplex device that transmits a signal train (i.e., a series of pulses) to the location server 226. The location server 226 can compute the current location of the restrained party from the received signal train. In any event, the location server 226 determines the current location of the restrained party, preferably in terms of the longitude and latitude associated the current geographic location of the restrained party. Similarly, the location server 226 can determine the current location of the restraining party, if necessary. The location server 226 can be an integral component of the alerting service on the SCP 214, or it can be part of an outside service that provides the location data to the SCP 214.

A media server 216, as is well known in the art, can be coupled to the PSTN 212 to enable the alerting service to initiate telephone calls, dispatch electronic mail, or otherwise establish communications with contacts that the user has set up to receive notifications that the restrained party is within a certain distance of a certain location. The alerting service can initiate a telephone call, for example, by sending a call request to the media server 216. The media server 216 places the call and plays an audio message informing the contact that the specified party has arrived at the specified location. The message can include the approximate time at which the restrained party moved within a specified distance of a specified location. The media server can be an integral component of the notification service on the SCP 214, or it can be part of an outside service that performs these functions for the alerting service. A wireless network 222 enables the alerting service to notify a contact via a wireless device 224, such as a mobile telephone, pager, PDA, or the like.

Figure 3:
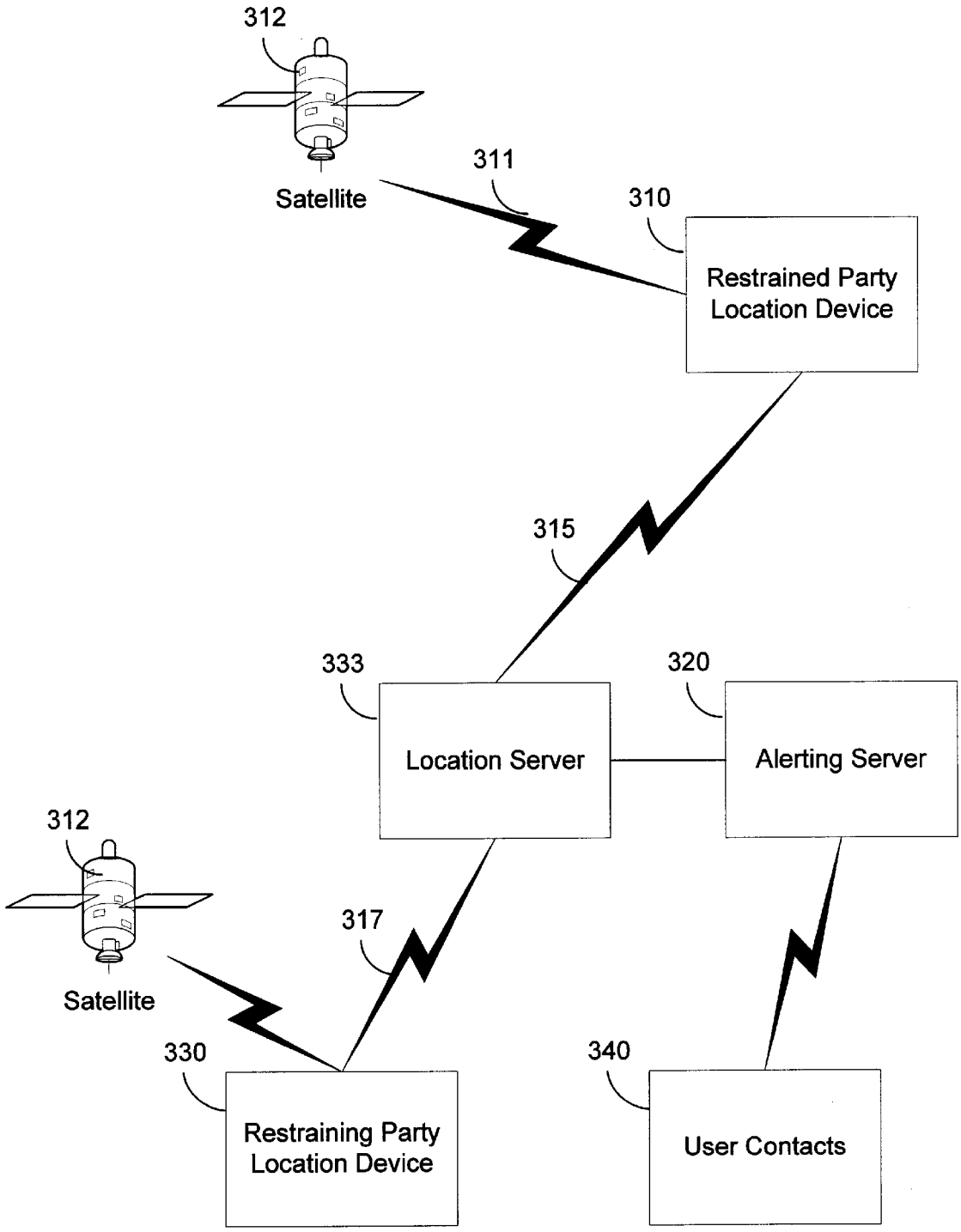
FIG. 3 is a functional block diagram of a system according to the invention.

FIG. 3 is a functional block diagram of a system according to the invention for providing notification of a location of a restrained party. Preferably, the restrained party wears a location device 310 that includes a GPS receiver that receives global positioning signals 311 from each of a plurality of GPS satellites 312. The receiver computes the current longitude and latitude of the restrained party from the global positioning signals 311, and transmits to the location server 333 a restrained party location signal 315 that includes the current longitude and latitude of the location of the restrained party. Alternatively, the restrained party location device 310 could provide the location signals 315 to the location server 333 by merely forwarding the global positioning signals to the location server 333. In this case, the location server 333 could determine the current longitude and latitude of the location of the restrained party from the global positioning signals. Similarly, the restraining party can also wear or carry a location device 330 that provides restraining party location signals 317 to the location server 333. Thus, as shown, any number of location devices 310, 330 can be communicatively coupled to the location server 333. Also, it should be understood that the location server 333 could include a single computer, or any number of computers working in combination.

Periodically, the location server 330 passes to the alerting server 320 current location data relating to the restrained party (and, where available, location data relating to the restraining party). The alerting server 320 could periodically "pull" the current location all data from the location server 330, or the location server 330 could periodically "push" the location data to the alerting server 320.

According to the invention, the alerting server 320 maintains a contacts table (see FIG. 5) having an entry associated with each user of the service. As will be described in detail below, the contacts table can contain contact data associated with each of one or more contacts 340 specified by the user. If the alerting service determines that the restrained party is within a specified distance from a specified location, the alerting service notifies the contacts 340. The contacts 340 can include the user, the restraining party (which may or may not be the user), emergency services, such as the police, for example, authorities, such as the courts, for example, or any other contacts that the user specifies for such notification. As shown, the alerting server 320 can provide notification to any number of contacts 340, associated with each of any number of users. Also, it should be understood that the alerting server 320 could include a single computer, or any number of computers working in combination.

Figure 4:
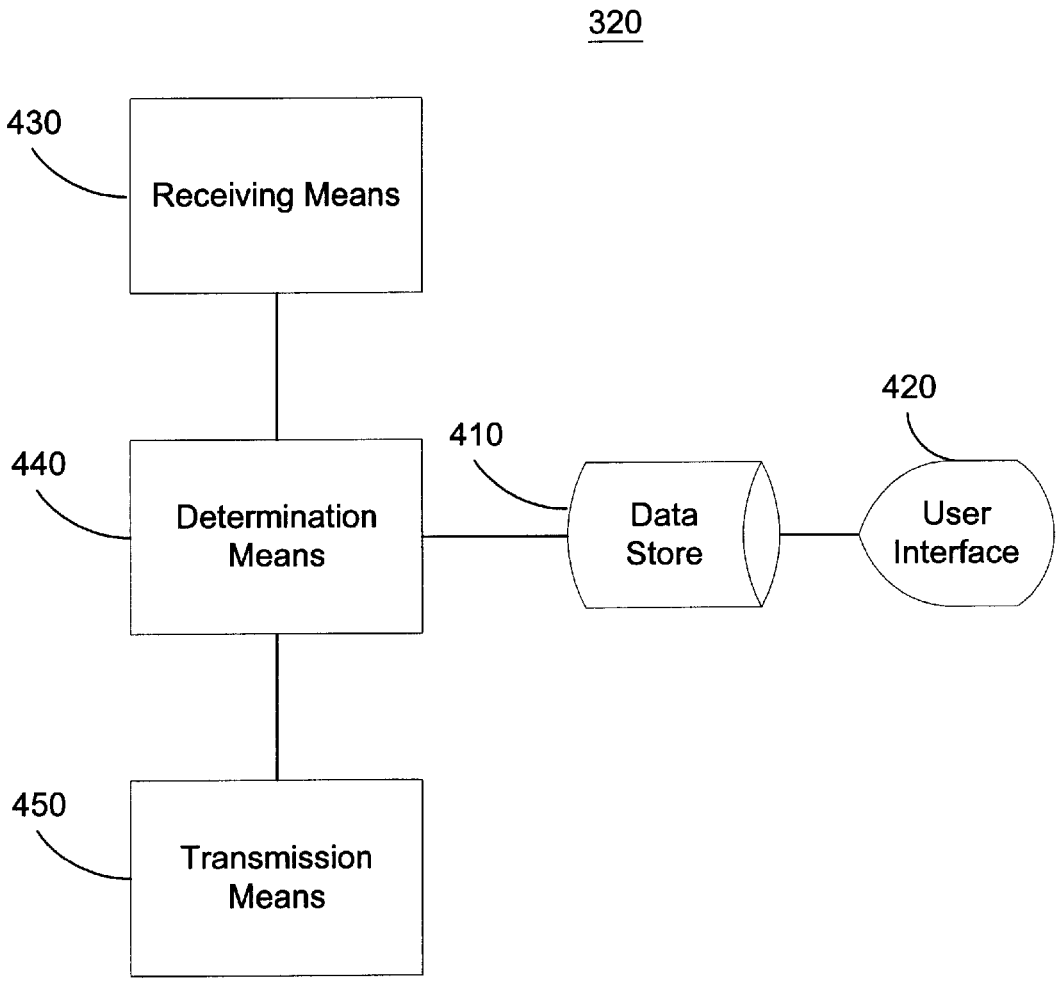
FIG. 4 is a block diagram of an alerting server according to the invention.

FIG. 4 is a block diagram of a preferred embodiment of a restraining order alerting server 320 according to the invention. As shown, the alerting server 320 can include a data store 410 that contains identity data that represents an identity of the restrained party, location data that represents a specified location, and distance data that represents a specified distance from the specified location. Preferably, the alerting server 320 also includes a user interface 420 via which the user can communicate with the alerting server 320 to provide data for storage in the data store 410.

According to the invention, the alerting server 320 includes receiving means 430 for receiving restrained party location signals that represent the current location of the restrained party. The alerting server 320 also includes determination means 440 that determines from the location signal, the location data, and the distance data whether the current location of the restrained party is within the specified distance from the specified location. The alerting server 320 includes transmission means 450 for transmitting an alert to each of the user specified contacts if the current location of the restrained party is within the specified distance from the specified location.

Preferably, the data in the data store 410 is stored as a contacts table 500, such as depicted in FIG. 5. The contacts table 500 includes a respective entry 510 associated with each user of the alert service. Each such entry can include a user signature 520, which can include, for example, a user ID 522 and password 524 associated with the respective user. The contacts table 500 can also include a restrained party ID 530 that is associated with the restrained party. The restrained party ID 530 can include an alphanumeric identifier 532 that is associated with the specified party (such as, an identifier that is associated with the restrained party's location device). The restrained party ID 530 can also include a "friendly" (or, more precisely, an "unfriendly") name 534 that the user recognizes as being associated with the restrained party.

The contacts table 500 can also include one or more locations 540. The locations 540 can include any locations that the restrained party is prohibited from being near, such as the restraining party's home or place of business. The locations 540 can also include any place that the user wants to know if the restrained party is near. According to the invention, a location 540 can be static (the location is fixed, such as the user's home or place of employment), or dynamic (the location varies, such as the current location of the restraining party or the user). Preferably, a static location 542 is identified in the contacts table 500 by the longitude and latitude of the location. Preferably, the user can input the static location data as a street address. The system then converts the user input street address into the longitude and latitude that correspond to that street address, and stores the longitude and latitude in the contacts table. A dynamic location 544 can be identified by a wildcard character (e.g., *).

The contacts table 500 also includes a respective distance 550 associated with each location 540. If the system determines that the restrained party is within the specified distance 550 from the corresponding location 540, then the system provides an alert to each contact 560 that the user has specified in the contacts table 500.

The contacts table 500 can also include one or more communications pathways 570 associated with each contact 560. If the system determines that the restrained party 530 is within the specified distance 550 from the specified location 540, then the system provides an alert to each contact 560 via the communications pathway(s) 570 specified for that contact 560. A communications pathway 570 can be identified by a telephone number 572, for example, which indicates that a telephone call should be placed to notify the contact, or a network address 574, which indicates that an email message, for example, should be dispatched to the contact.

The data store 410 can also contain alert message data that corresponds to each type of communications pathway 570 (i.e., whether the communications pathway calls for a text message or an audio message). For example, if the communications pathway is by telephone, then an audio message can be stored in the data store, and played when the phone call is answered. A message such as "This is the alert service. Please be advised that Fred is within 10 miles of Wilma's house." can be played to a user of the service. A different message might go to the police or the court, which can be notified in case of a violation of the restraining order. "Please be advised that a violation of restraining order 64521 has been detected. Mr. Flintstone is currently within 10 miles of Mrs. Flintstone's residence at 123 Pebble Rock Drive. Mr. Flintstone is currently located at the corner of Fourth and Main." A similar text message can also be stored in the data store for use where the communication pathway indicates that an email should be sent, for example, or where the telephone number corresponds to a pager or other Internet appliance that includes an electronic text display. The alert message can be recorded for evidence of a violation by any of the contacts or by a voicemail service that is ancillary to the alert service and set up for precisely this purpose.

Figure 6A:
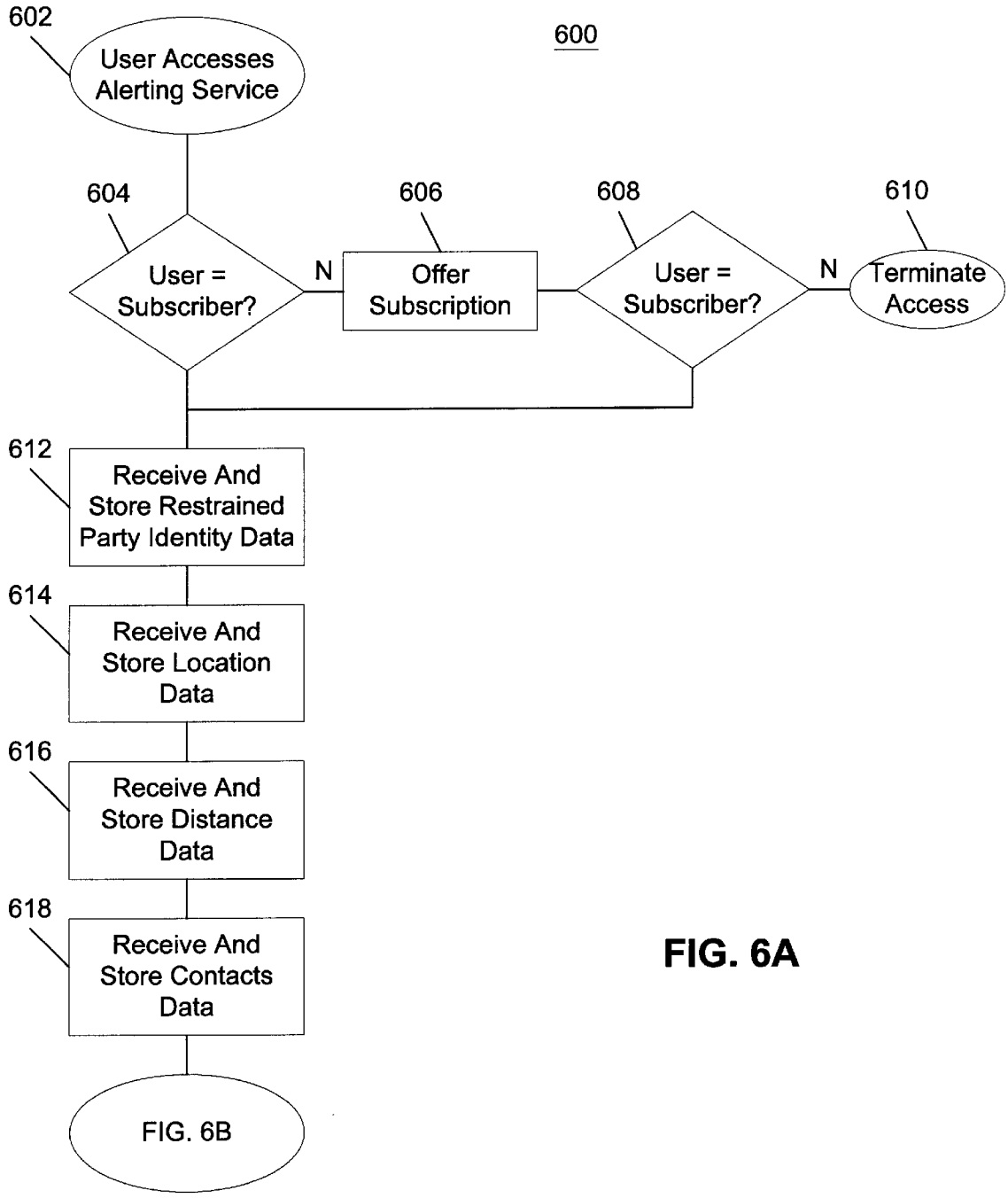
FIGS. 6A and 6B provide a flowchart of a method according to the invention.
Figure 6B:
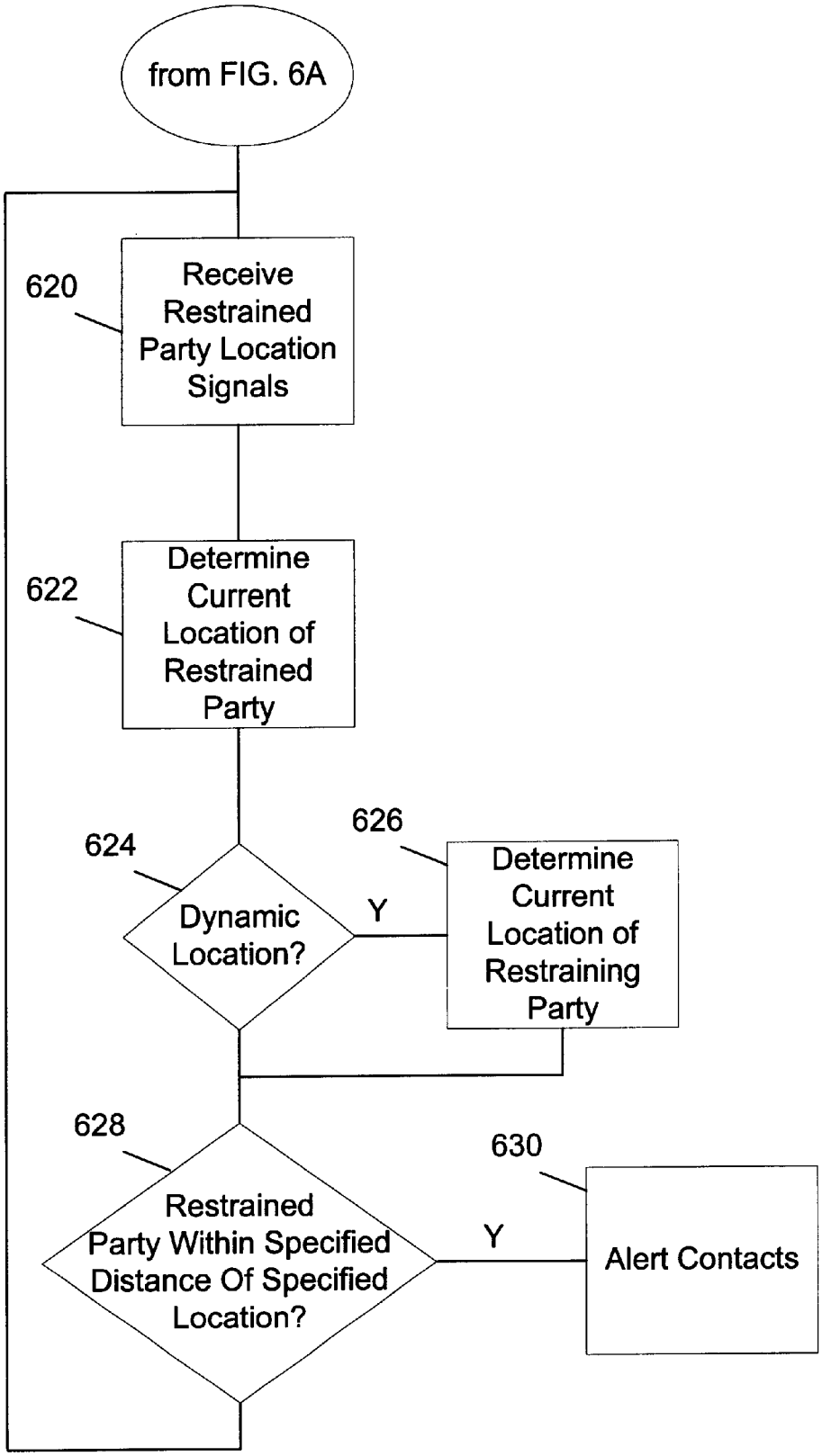

FIGS. 6A and 6B provide a flowchart of a method 600 according to the invention. At step 602, a user accesses the alerting service to provide data necessary to set up a user profile in the data store. The user can be the restraining party or any third party desiring to use the service. The user can access the alerting service via telephone (e.g., by dialing a telephone number associated with the service), or via the Internet (e.g., by using a browser on the user's computer to connect to a web site that the alerting service provides).

In a preferred embodiment of the invention, the service is implemented as a subscription service. That is, only paid subscribers can utilize the service. It should be understood, however, that the service could also be implemented such that a subscription is unnecessary. If the service is implemented as a subscription service, then, at step 604, the service determines whether the user is a subscriber to the service. Otherwise, the service skips to step 612.

Preferably, the service includes a data store that contains a respective account ID and a user signature for each subscriber. A user signature can include, for example, a user ID/password combination associated with the respective subscriber. The account ID can be, for example, a unique alphanumeric identifier that the service assigns to the respective subscriber's account. At step 604, the service invites the user to input a user signature, and determines whether the user is a subscriber by determining whether the input signature is in the data store. Preferably, the service also provides a mechanism by which the user can change his/her signature (e.g., by changing his/her password), and by which the user can provide a friendly name associated with him/herself.

If, at step 604, the alerting service determines that the user is not a subscriber (e.g., if the input user signature is not in the data store), then, at step 606, the service provides a user interface via which the user can subscribe to the service. For example, if the service is implemented as a telephone based service, the service can invite the user to subscribe by providing an audio message such as "If you wish to subscribe to this service, please press or say '1.'" The service can then prompt the user to set up an account (e.g., input a signature, friendly name, and preferred payment information) using the telephone keypad or transceiver. Similarly, if the service is implemented as a web-based service, the service can invite the user to subscribe by providing a window (or a link to a subscription web page) that enables the user to set up an account.

At step 608 the service determines whether the user has elected to subscribe. If, at step 608, the service determines that the user has not elected to subscribe (e.g., the user cancels the transaction or does not input the requested data within a certain timeout period), then, at step 610, the service terminates access (by disconnecting the telephone call or providing an error message on the web page, for example).

If the service determines that the user is a subscriber, or if the service is not implemented as a subscription service, then, at step 612, the service begins to request from the user certain data that will enable the service to determine whether a restrained party is within a certain distance of a specified location. (If the service is not implemented as a subscription service, then the service can invite a first-time user to set up an account by entering a user signature and friendly name.)

At step 612, the services invites the user to enter a restrained party identifier that is associated with the restrained party (i.e., the person subject to the restraining order). It is contemplated that the issuing authority will require the restrained party to participate in the service (e.g., by requiring the restrained party to wear a location signal device such as described above). Accordingly, the service is preferably implemented such that the issuing authority also provides to the alerting service a respective restrained party identifier that is associated with each restrained party. Alternatively, the service can be implemented such that the service has access (via a secure Internet connection, for example) to one or more data stores maintained by the issuing authority to include the restrained party IDs.

The user input restrained party ID can be the restrained party's name, for example, or an alphanumeric code that the issuing authority assigns, or any other such unique identifier that the service can use to determine whether the user input ID corresponds to a restrained party whose ID has been provided by the issuing authority. In this way, the service can verify that the party that the user is identifying as a restrained party is, in fact, subject to a restraining order. If the service determines that the user input restrained party ID does not correspond to a restrained party ID provided by an issuing authority (e.g., it is not in the data store), then the service can provide the user with an error message that indicates that the alerting service will not be provided because the restrained party ID is unrecognizable.

If the user input restrained party ID corresponds to a restrained party ID provided by an issuing authority, then the restrained party ID is stored in an entry in the contacts table that is associated with the user. The user can also be invited to provide a friendly name associated with the restrained party. The friendly name is also stored in the user's entry in the contacts table.

It should be understood that the service could be implemented such that the user signature is pre-assigned by the issuing authority as well, and automatically associated with the restrained party ID. In such an embodiment, when the user logs in to the service, the service would already "know" the restrained party ID associated with that user.

At step 614, the service invites the user to input location data associated with one or more locations. Preferably, the location data can include data that represents a location that the restrained party is prohibited from being near (e.g., the restraining party's home or place of business). The location can be a location specified in the restraining order, or any other location that the restraining party desires. In this way, the service can be used not only to provide notice of a restraining order violation, but also to provide notice to the user as to whether the restrained party is near any other location of interest (e.g., the school of the restraining party's children or the restraining party's parents' house). The service receives the location data from the user, and stores the location data in the user's entry in the contacts table.

Preferably, location data can correspond to a static location (e.g., the restraining party's home or place of business), or a dynamic location (e.g., the location of the restraining party regardless of where the restraining party is located). If the location data corresponds to a static location, the location data can be provided as a street address and converted to longitude/latitude data for storage in the user's entry in the contacts table. If the location data corresponds to a dynamic location, the service can store a wildcard character in the user's entry in the contacts table.

It should be understood that the service could be implemented to automatically receive location data associated with a location proscribed in the restraining order from the issuing authority so that the user need not necessarily provide it to the service.

At step 616, the service invites the user to input respective distance data associated with each of the one or more locations. The distance data represents the minimum distance that the restrained party must keep from the associated location in order to avoid the service's notifying the contacts associated with the user. The service stores the distance data in the user's entry in the contacts table. The distance data can represent a distance specified in the restraining order, or any other distance that the user desires to trigger notification. Preferably, distance is specified in units of miles, though any suitable units can be used. Again, it should be understood that the service could be implemented to automatically receive distance data from the issuing authority so that the user need not necessarily provide it to the service.

At step 618, the service invites the user to input contacts data associated with one or more contacts that the user would like to be notified if the restrained party is found within the specified distance of a specified location. Contacts can include the user/subscriber, the restraining party (if someone other than the restraining party is the user/subscriber), one or more third parties (e.g., where the restraining party wishes to have her father/husband/friend notified that the restrained party is within the specified distance), an emergency service (such as the police), or an authority (such as the issuing authority). The contacts can also include a voicemail service, for example, that is enabled to store a record of the event.

For each contact that the user specifies, the user inputs a communications pathway to that contact. For example, the user may wish to be notified via his mobile telephone. Accordingly, the user can provide his mobile telephone number and an indication that the notification should include an audio message. Should the user desire to keep electronic records of violations or other encroachments by the restrained party, the user can specify an email address, for example, along with an indication that the notification should include a text message. Similarly, the user can set up his account to trigger a telephone call to 911, the issuing authority, or any third parties, a pager, PDA, or any other communications device that can receive a notification that includes a text or audio message.

After the user account is set up, the service begins monitoring, at step 620, by receiving restrained party location signals emitted by the restrained party's location device. It is contemplated that the issuing authority will order the restrained party to wear either a simplex pulse emitter (such as an ankle bracelet, for example) or a device that includes a GPS receiver and a signal transmitter. It should also be understood that, however unlikely it might be, the restrained party might volunteer to wear such a signal transmitter without being ordered to do so by the court.

At step 622, the service determines the current location of the restrained party. In an embodiment wherein the restrained party's location device includes a GPS receiver, the device can transmit location signals that include an identifier associated with the restrained party (such as an identifier associated with the restrained party's location device, for example), and the longitude and latitude associated with the restrained party's current location. In such an embodiment, the service can extract the restrained party ID and longitude and latitude data from the restrained party location signals. In an embodiment wherein the restrained party location device is a simplex transmitter, the service can calculate the longitude and latitude from the signals.

At step 624, the service determines, from the location data in the user's entry in the contacts list, whether dynamic location is necessary. If, at step 624, the service determines that dynamic location is necessary, then, at step 624, the service determines the current location of the restraining party. The restraining party can wear (or carry) a location device that includes a GPS signal receiver and a transmitter that transmits restraining party location signals that include a restraining party ID, as well as the longitude and latitude of the current location of the restraining party. The service can extract the longitude and latitude data from the restraining party location signals.

At step 628, for each of the one or more locations specified in the user's entry in the contacts table, the service determines whether the restrained party is within the specified distance from the specified location. Using the longitude and latitude of the current location of the restrained party, and the longitude and latitude of the specified location, the service computes the current distance between the restrained party and the specified location. If the current distance between the restrained party and the specified location is less than the specified distance associated with the specified location, then the service concludes that the restrained party is within the specified distance of the specified location.

If, at step 628, the service determines that the restrained party is within the specified distance of the specified location, then, at step 630, the service notifies the contacts in the user's entry in the contacts table. Each contact is notified via the communications pathway associated with that contact in the contacts table. For example, if the contact is the restraining party and the communications pathway is the restraining party's mobile telephone, the service can automatically place a telephone call to the restraining party's mobile telephone number, and provide an audio message such as "Wilma, This is the Alerting Service. Fred is within 10 miles of your current location." If the contact is an email address, for example, the service can dispatch an email notification that includes a text message such as "On [date], at [time], Barney was found to be within one mile of Betty's home." Similarly, the service can initiate a telephone call to 911 or the issuing authority with an audio message such as "A violation of restraining order 1234 has been detected. Fred Flintstone is currently located at 56 Seventh Street." It is preferred, however, that such authorities as 911 and the issuing authority be notified only in the event of an actual violation of the restraining order.

If, at step 628, the service determines that the restrained party is not within the specified distance of the specified location, then the service returns to step 620 and continues monitoring.

Thus, there have been described systems and methods that provide notification that a restrained party is within a specified distance of a specified location. Those skilled in the art will appreciate that numerous changes and modifications can be made to the preferred embodiments of the invention, and that such changes and modifications can be made without departing from the spirit of the invention. It is intended, therefore, that the appended claims cover all such equivalent variations as fall within the true spirit and scope of the invention.

What is claimed is:

1. A system for providing notification of a location of a restrained party, the system comprising:

receiving means for receiving a restrained party location signal that represents a current location of a restrained party;

a data store hosted on a service control point (SCP) in an advanced intelligent network (AIN), said data store containing location data that represents a specified location and distance data that represents a specified distance from the specified location; and transmission means for sending a message to a service switching point (SSP) in the AIN if the current location of the restrained party is within the specified distance from the specified location, said message causing said SSP to transmit an alert on an associated calling line to one or more pieces of terminating equipment on the calling line.

2. The system of claim 1, further comprising:

determination means for determining from the location signal, the location data, and the distance data whether the current location of the restrained party is within the specified distance from the specified location.

3. The system of claim 1, wherein the transmission means causes the SSP to transmit the alert to an authority.

4. The system of claim 3, wherein the data store contains data that represents a communication pathway via which the alert can be transmitted to the authority.

5. The system of claim 1, wherein the transmission means causes the SSP to transmit the alert to a user-specified contact.

6. The system of claim 5, wherein the user-specified contact is a restraining party.

7. The system of claim 5, wherein the data store contains data that represents a communication pathway via which the alert can be transmitted to the user-specified contact.

8. The system of claim 1, wherein the specified location is a location associated with a restraining party.

9. The system of claim 8, wherein the specified location is a current location of the restraining party.

10. The system of claim 9, further comprising:

receiving means for receiving a restraining party location signal that represents the current location of the restraining party.

11. The system of claim 10, further comprising:

a restraining party location device that is adapted to be worn or carried by the restraining party and to transmit the restraining party location signal.

12. The system of claim 11, wherein the restraining party location device comprises a global positioning system signal receiver that is adapted to receive global positioning signals from each of a plurality of global positioning system satellites.

13. The system of claim 8, wherein the specified location is a location corresponding to the restraining party's house.

14. The system of claim 8, wherein the specified location is a location corresponding to the restraining party's place of business.

15. The system of claim 8, wherein the specified location is a location specified in a restraining order.

16. The system of claim 8, further comprising:

receiving means for receiving a restraining party location signal that represents a current location of the restraining party.

17. The system of claim 1, further comprising:

a restrained party location device that is adapted to be worn or carried by the restrained party and to transmit the restrained party location signal.

18. The system of claim 17, wherein the restrained party location device comprises a global positioning system signal receiver that is adapted to receive global positioning signals from each of a plurality of global positioning system satellites.

19. The system of claim 18, wherein the restrained party location signal includes the global positioning signals.

20. The system of claim 1, wherein the restrained party location signal includes a longitude and a latitude associated with a location of the restrained party.

21. The system of claim 1, further comprising:

a user interface via which a user can provide at least one of the location data and the distance data.

22. The system of claim 1, further comprising:

a user interface via which a user can provide data that represents a communication pathway via which the alert can be transmitted.

23. A system for providing notification of a location of a restrained party, the system comprising:

means for determining whether a restrained party is within a specified distance of a specified location; and means for sending a message to a service switching point (SSP) in an advanced intelligent network (AIN) if the restrained party is within the specified distance of the specified location, said message causing said SSP to transmit an alert on an associated calling line to one or more pieces of terminating equipment on the calling line.

24. A method for providing notification of a location of a restrained party, the method comprising:

receiving a restrained party location signal that represents a current location of the restrained party;

storing in a data store location data that represents a specified location and distance data that represents a specified distance from the specified location, said data store being hosted on a service control point (SCP) in an advanced intelligent network (AIN);

determining from the location data and the distance data whether the current location of the restrained party is within the specified distance from the specified location; and sending a message to a service switching point (SSP) in an advanced intelligent network (AIN) if the current location of the restrained party is within the specified distance from the specified location, said message causing said SSP to transmit an alert on an associated calling line to one or more pieces of terminating equipment on the calling line.

* * * * *

UNITED STATES PATENT AND TRADEMARK OFFICE

CERTIFICATE OF CORRECTION

PATENT NO. : 6,850,163 B1 
DATED : February 1, 2005
INVENTOR(S) : Maria Adamczyk and Hong Thi Nguyen It is certified that error appears in the above-identified patent and that said Letters Patent is hereby corrected as shown below:

Column 1,
Line 11, delete “disclose” and substitute therefore -- disclosed --.
Line 13, delete “10/179,340filed” and substitute therefore -- 10/179,340 filed --.

Column 5,
Line 19, delete “6f” and substitute therefore -- of --.

Signed and Sealed this

Eighteenth Day of October, 2005

JON W. DUDAS
*Director of the United States Patent and Trademark Office*